US006325130B1

(12) United States Patent
Kageyama et al.

(10) Patent No.: US 6,325,130 B1
(45) Date of Patent: Dec. 4, 2001

(54) COAT TRANSFER TOOL

(75) Inventors: Hidehei Kageyama; Sadahiro Anzai; Yoshihide Mitsuya, all of Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/411,235

(22) Filed: Oct. 4, 1999

(30) Foreign Application Priority Data

Jun. 25, 1999 (JP) ..... 11-180627

(51) Int. Cl.[7] ..... B32B 31/00

(52) U.S. Cl. ..... 156/577; 156/523; 156/579; 118/76; 242/160.4; 242/171; 242/588.6

(58) Field of Search ..... 156/238, 523, 156/527, 540, 574, 577, 579; 118/76, 200, 257; 225/46; 242/160.2, 160.4, 170, 171, 588, 588.2, 588.3, 588.6

(56) References Cited

U.S. PATENT DOCUMENTS 4,849,064 * 7/1989 Manusch et al. ..... 156/577
4,851,076 7/1989 Manusch et al. .
4,853,074 8/1989 Manusch et al. .

* cited by examiner

*Primary Examiner*—Mark A. Osele
(74) *Attorney, Agent, or Firm*—McGinn & Gibb, PLLC

(57) ABSTRACT

A coat transfer tool includes a case having a plate-shaped part, a feed reel provided in the case and wound with a coat transfer tape, a takeup reel provided in the case, for taking up the carrier tape fed by the feed reel, and an applying strip disposed on the path of the tape running between the feed reel and the takeup reel and pressed against a surface of a substrate. An elastic pressing arm protrudes from the plate-shaped part of the case to be kept in contact with a surface of the applying strip and to elastically press the applying strip in a direction substantially vertical to the surface.

20 Claims, 9 Drawing Sheets

COAT TRANSFER TOOL

BACKGROUND OF THE INVENTION

1. Field of the Invention

The present invention relates to a coat transfer tool for serving as an eraser, marker, glue or the like by transferring a coat of, for example, correction composition, fluorescent composition or adhesive composition (hereinafter referred to as "a coat of composition") from a carrier tape to a substrate such as paper.

2. Description of the Related Art

Commercially available coat transfer tools of this kind generally include a feed reel provided in a case and wound with a coat transfer tape, a takeup reel, provided in the case, for winding a carrier tape which is fed from the feed reel and whose coat of composition has been peeled off, a transmitting unit for transmitting revolutions between the feed reel and the takeup reel and an applying strip disposed on the path of the tape running between the feed reel and the takeup reel and adapted to be pressed against a surface of a substrate, for example, a paper surface to transfer the coat onto the substrate surface.

To neatly transfer the coat onto the substrate surface using the applying strip, or to neatly cut the transferred tape off the substrate surface, the applying strip should be kept at an appropriate angle to the substrate surface. This requires elastic displacement of the tip of the applying strip with relation to the case.

However, as the conventional coat transfer tool causes the applying strip to be deformed by its own elasticity, a problem results in that its elastic displacement is subject to an inevitable limit and the applying strip is difficult to manufacture.

SUMMARY OF THE INVENTION

In view of the foregoing and other problems, disadvantages, and drawbacks of the conventional writing utensils, the present invention has been devised, and it is an object of the invention to provide a writing utensil that can be inexpensively manufactured and easily assembled. Further, to provide a coat transfer tool which can facilitate the manufacture of the applying strip and enables the applying strip to attain adequate elastic displacement.

In order to attain the object suggested above, there is provided, according to one aspect of the invention, a coat transfer tool including a case having a plate-shaped part, a feed reel provided in the case and wound with a coat transfer tape, a takeup reel, disposed in the case, for winding the carrier tape which is fed from the feed reel and whose coat of composition has been peeled off, a transmitting unit for transmitting revolutions between the feed reel and the takeup reel slippably, and an applying strip disposed on the path of the tape running between the feed reel and the takeup reel and pressed against a surface of a substrate. Additionally, there is an elastic pressing body, projecting from the plate-shaped part of the case and maintained in contact with a general surface of the applying strip, for elastically pressing the applying strip against the general surface in a substantially vertical direction.

As the elastic pressing body provides a sufficient elastic force to the applying strip, the force that the applying strip receives from the surface of the substrate is buffered and, simultaneously when a coat layer of the tape is to be transferred and when the coat layer of the tape is to be cut, the applying strip can be placed at respective, appropriate angles relative to the surface of the substrate. Therefore, when transferring is to be continued, the coat layer is reliably supplied from the transferring tool to the surface of the substrate without being unintentionally cut and, when transferring is to be completed, the coat layer can be neatly cut.

According to a second aspect of the invention, the elastic pressing body protrudes from, and is integrated with, the plate-shaped part of the case. As the elastic pressing body and the case are integrated (e.g., integrally formed), the elastic pressing body can be disposed without increasing the number of parts.

According to a third aspect of the invention, the plate-shaped part of the case integrated with the elastic pressing body, as in the second aspect of the invention, has a side window where it overlaps with the elastic pressing body as viewed in a direction substantially orthogonal to the plate-shaped part. As the side window is formed, the elastic pressing body can be readily formed with the case.

According to a fourth aspect of the invention, an edge of the side window of the case, as in the third aspect of the invention, is provided with a limiting unit to limit the movement of the elastic pressing body. As the movement of the elastic pressing body is limited by the limiting unit, the displacement of the applying strip can also be limited.

According to a fifth aspect of the invention, a supporting body, for supporting the base of the applying strip, is formed integrally with the elastic pressing body according to any one of the first through fourth aspects of the invention. As the supporting body is also integrated with the elastic pressing body, the applying strip can be supported without entailing an increase in the number of parts.

According to a sixth aspect of the invention, the case, according to any one of the first through fifth aspects of the invention, includes an upper case and a lower case, either one having formed within, a protruding shaft for pivoting either the feed reel or the takeup reel. The protruding shaft has a pair of engaging pieces whose tips are separated and oppose each other, and an engaging part is formed at the tip of each engaging piece. The other one of the upper or the lower case is provided with an engaging projection, engaged by the engaging parts, to be gripped by the pair of engaging pieces. Slits are formed near the engaging projection corresponding to the engaging parts.

The upper case and the lower case can be combined by causing an engaging projection, provided on either one of the upper case or the lower case, to engage with engaging parts provided on the other case and to be gripped by a pair of engaging pieces. If a need arises to detach the upper case and the lower case from each other after they have been combined, the projection can be disengaged by operating the engaging parts through the corresponding slits, thereby enabling the upper case and the lower case to be separated from each other.

The present disclosure relates to subject matter contained in Japanese Patent Application No. Hei 11-180627, filed on Jun. 25, 1999, and which is expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF PREFERRED EMBODIMENTS OF THE INVENTION

Figure 1:
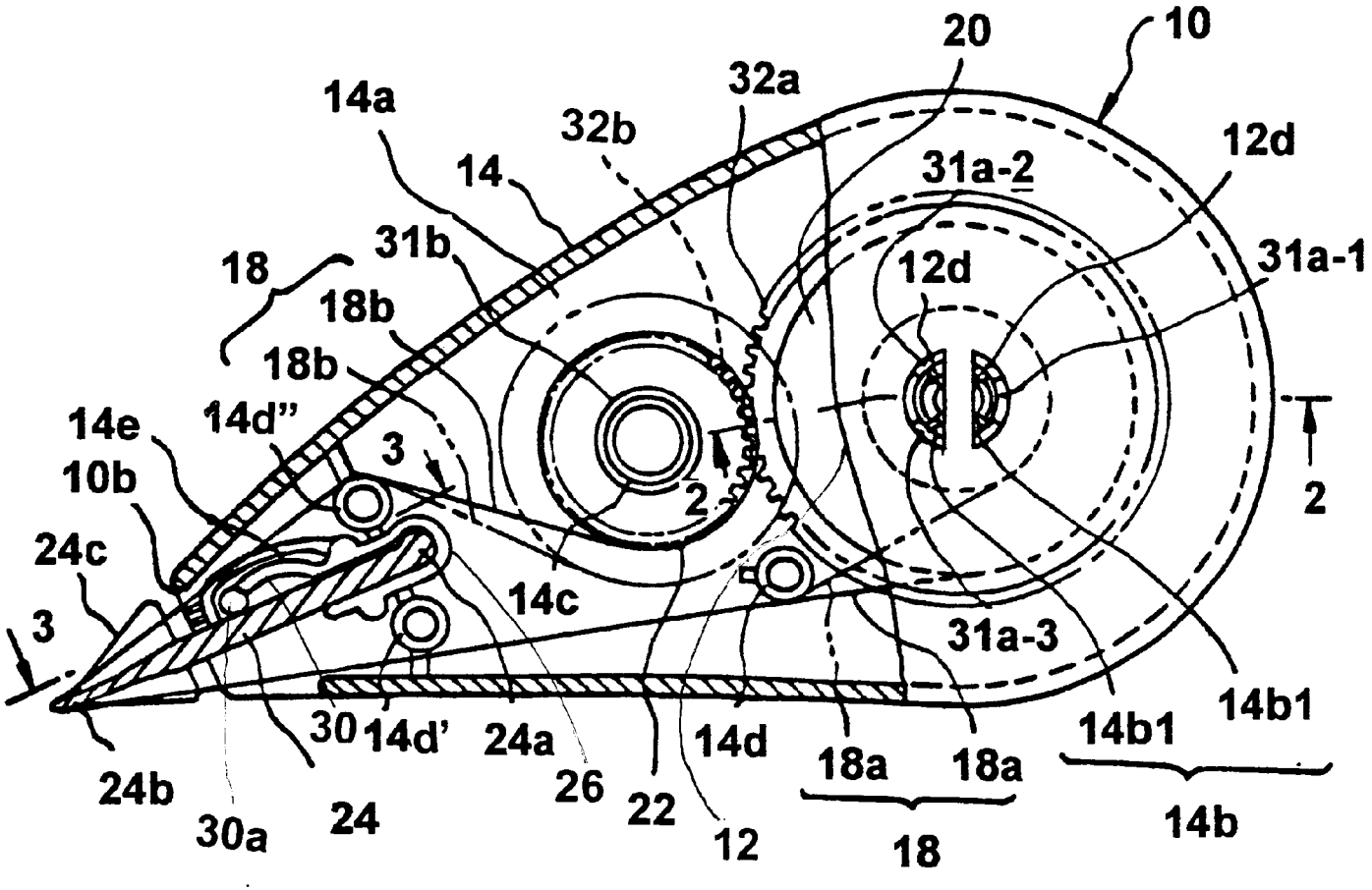
FIG. 1 is a partial cutaway view illustrating a coat transfer tool according to a first embodiment of the invention.

Referring now to the drawings, and more particularly to FIGS. 1–11, there are shown preferred embodiments of the method and structures according to the present invention.

First Embodiment

Referring to FIGS. 1–8, there is illustrated a coat transfer tool according to a first embodiment of the present invention. A coat transfer tape which is employed in the coat transfer tool can be conventional having a coat of composition coating one side of a plastic carrier film through a peeling layer, and a layer of adhesive, such as pressure sensitive adhesive, coating the coat of composition.

As shown in FIG. 1, the coat transfer tool has a case 10 which includes an upper case 12 and a lower case 14, which are combined to form a closed space with an opening 10*b* at one end of the closed space.

Within the case 10 are rotatably pivoted a feed reel 20, wound with a coat transfer tape 18*a*, and a takeup reel 22, for taking up a carrier film 18*b*, which has been fed from the feed reel 20 and whose coat of composition has been peeled off. The feed reel 20 and the takeup reel 22 are respectively fitted to boss parts 31*a* and 31*b* of gears 32*a* and 32*b* rotatably mounted on protruding shafts 14*b* and 14*c* projecting from a plate-shaped part 14*a* of the lower case 14.

Figure 2:
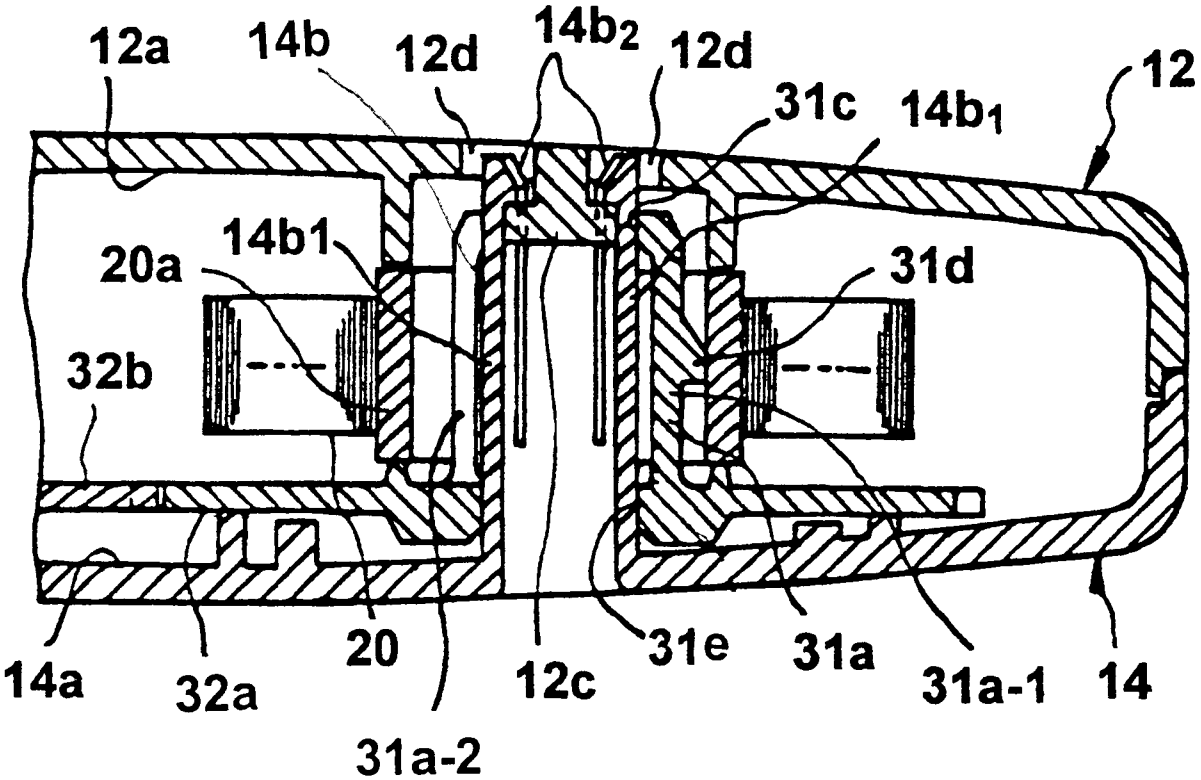
FIG. 2 is a sectional view taken along a line 2—2 in FIG. 1.

Referring to FIG. 2, the projecting shaft 14*b* of the lower case 14 includes a plurality of (e.g., four in the illustrated example) pieces, the tips of which are separated from one another, and one opposing pair of pieces, among the plurality of the pieces, extending upward to configure engaging pieces 14*b*1 inside whose upper ends are formed engaging parts 14*b*2. The upper case 12 is provided at a plate-like part 12*a* thereof with an engaging projection 12*c* which engages the engaging parts 14*b*2 to be gripped between the engaging pieces 14*b*1.

In portions of the upper case 12 which are adjacent both sides of the engaging projection 12*c* are formed slits 12*d*, into which the engaging parts 14*b*2 extend. The upper case 12 and the lower case 14 are combined together by the engagement of the engaging pieces 14*b*1 and the engaging projection 12*c*. Alternatively, either the upper case 12 or the lower case 14 can be provided with a projection and the other case with a projecting shaft having a receptacle (e.g., hole) to accommodate that projection, and the projection is fitted into this receptacle. The projecting shaft may also serve as a guide pin which will be described below.

The position of the engaging parts 14*b*2 corresponds to the slits 12*d* and is adjustable externally through the slits 12*d*, if internal adjustment is required after the upper case 12 and the lower case 14 have been joined. The upper case 12 can be detached from the lower case 14 by expanding the gap between the two engaging parts 14*b*2 with a jig, or the like, through the slits 12*d* and by disengaging the engaging parts 14*b*2 and the engaging projection 12*c* from each other.

Incidentally, it is possible to structure the projecting shaft 14*c* pivoting the takeup reel 22 in a similar way instead of configuring the projecting shaft 14*b* which comprises the engaging pieces 14*b*1 and pivots the feed reel 20, and provide an engaging projection in the corresponding position on the upper case 12.

Further, the opening 10*b*, shown in FIG. 1, is provided with an applying strip 24. Longitudinal walls 24*c* for guiding the tape 18*a* are integrally formed on both sides of a tip 24*b* of the applying strip 24. A general surface of the applying strip 24 is substantially vertical to a general surface of the plate-shaped part 12*a* or 14*a* of the upper case 12 or the lower case 14. Base 24*a* of the applying strip 24 is supported by a supporting body 26 protruding from the plate-shaped part 14*a* of the lower case 14. The supporting body 26 surrounds the base 24*a* on three sides, but a gap 28 (e.g., FIG. 7) is provided between the two elements, so that the applying strip 24 can be displaced relative to the supporting body 26.

Figure 4:
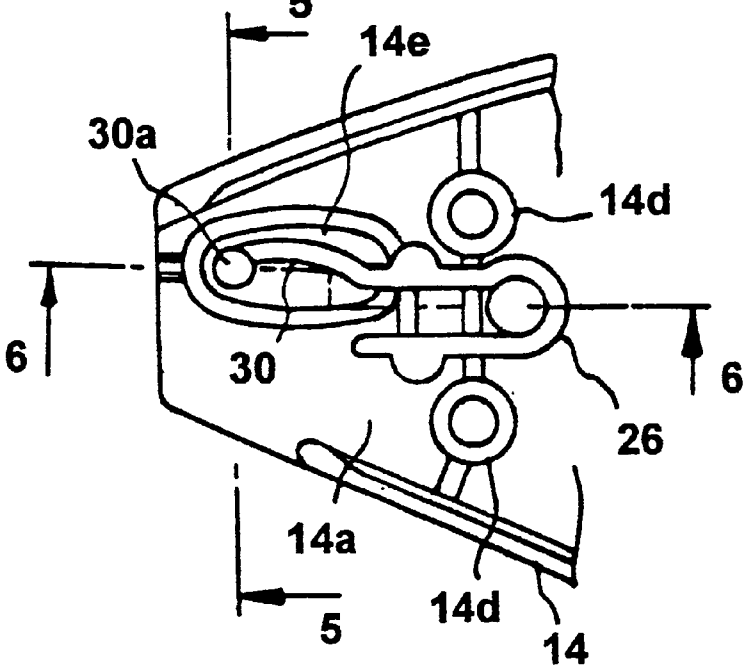
FIG. 4 is a partial plan view of a lower case in FIG. 1.
Figure 3:
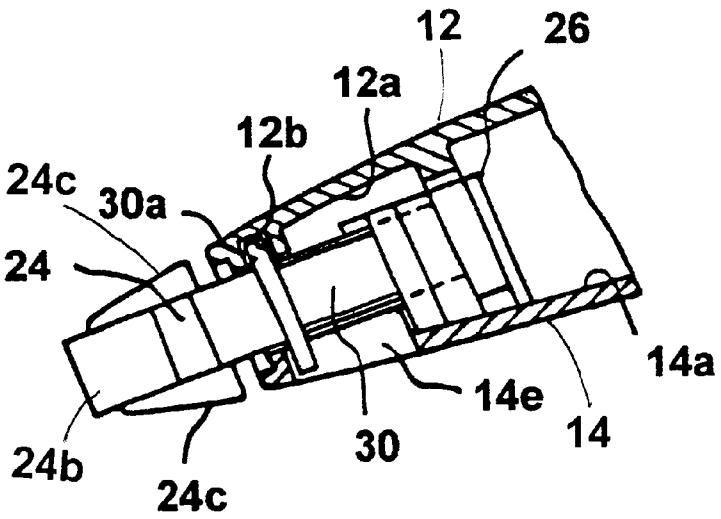
FIG. 3 is a sectional view taken along a line 3—3 in FIG. 1.
Figure 6:
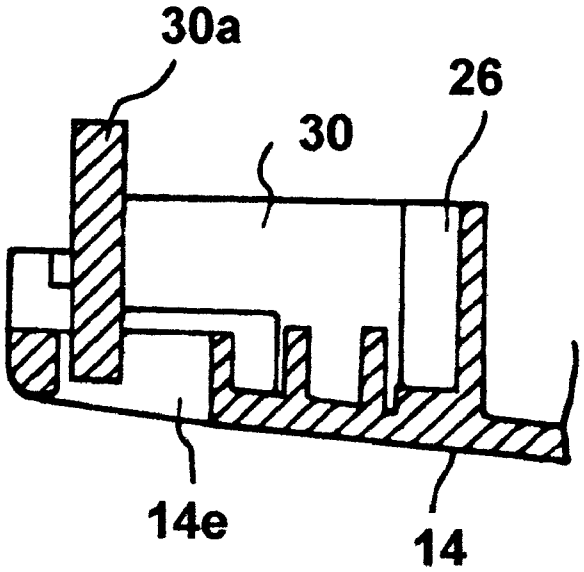
FIG. 6 is a sectional view taken along a line 6—6 in FIG. 4.
Figure 5:
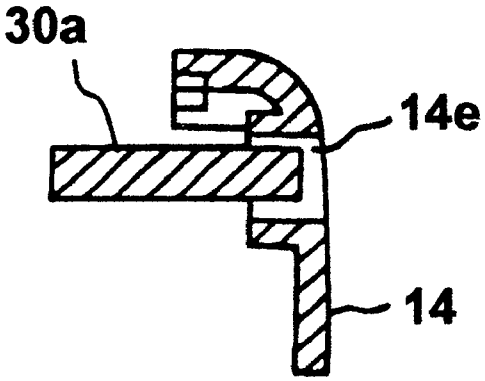
FIG. 5 is a sectional view taken along a line 5—5 in FIG. 4.
Figure 7:
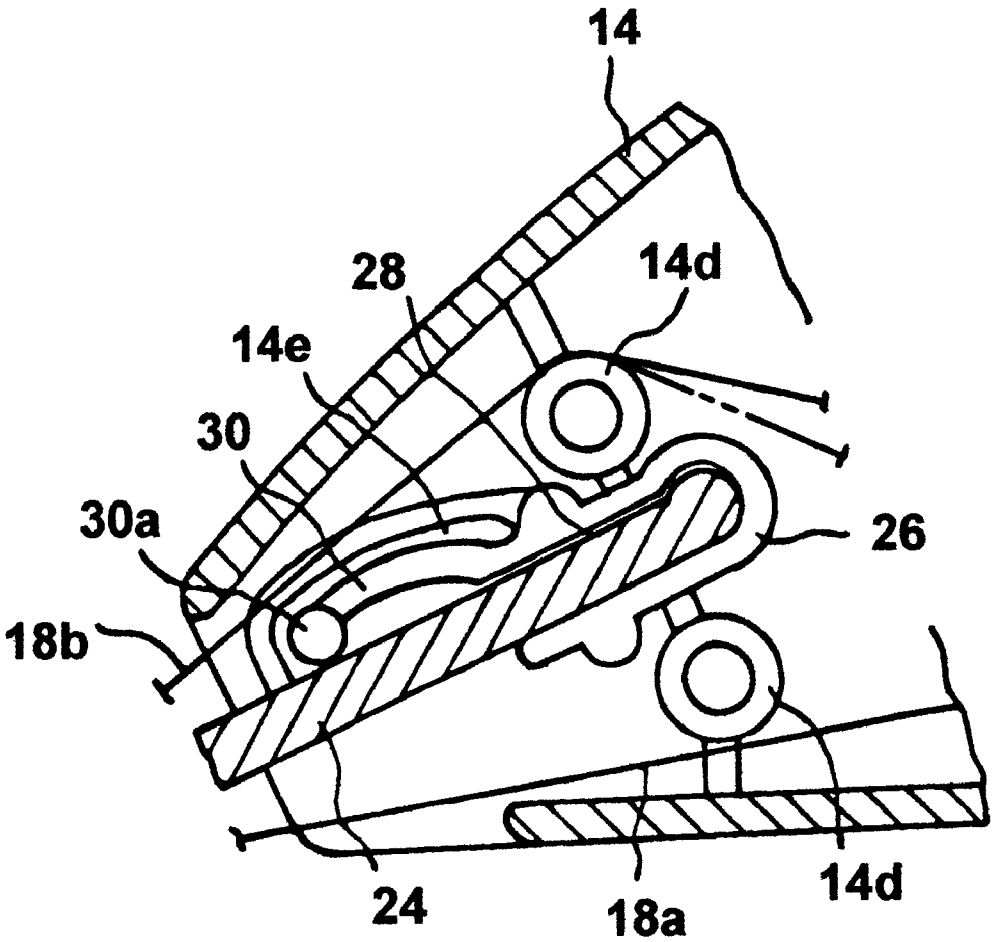
FIG. 7 is a partial enlarged view of FIG. 4.

Referring to FIG. 4, longitudinally extending from the supporting body 26 which protrudes integrally from the plate-shaped part 14*a* of the lower case 14 is an elastic pressing arm 30 which is an elastic pressing body. The tip 30*a* of the elastic pressing arm 30 is in contact with the general surface of the applying strip 24 in the intermediate part of the applying strip 24, and elastically presses the applying strip 24 in a direction substantially vertical to its general surface. In the plate-shaped part 14*a* of the lower case 14, a side window 14*e* is formed in the part overlapping the elastic pressing arm 30 as viewed in a direction vertical to the plate-shaped part 14*a*, to mold the elastic pressing arm 30 integrally with the lower case 14.

As illustrated in FIGS. 3–7, one end of the tip 30*a* in the vertical direction extends into the side window 14*e*, and the displacement range of the tip 30*a* is limited by the edge of the side window 14*e* (e.g., a limiting unit). Similarly, the other end of the tip 30*a* in the vertical direction is movably fitted into a recess 12*b* of the upper case 12, and its displacement range is thereby limited. To give elasticity to the elastic pressing arm 30, the lower case 14, which is molded integrally with the elastic pressing arm 30, may be formed of a highly elastic material such as polypropylene, ABS resin, or the like. However, where sufficient elasticity can be secured by appropriately shaping the elastic pressing arm 30, styrol resin, AS resin or the like are acceptable.

The applying strip 24 is positioned on the running path of the tape 18*a* and the carrier film 18*b* traveling between the feed reel 20 and the takeup reel 22. The coat transfer tape 18*a*, fed from the feed reel 20 and guided by guide pins 14*d* and 14*d*' disposed within the case 10, passes around the tip 24*b* of the applying strip 24. The coat transfer tape 18*a* is pressed by the tip 24*b* of the applying strip 24 against a surface of a substrate such as a paper surface, thereby causing the composition to be transferred to that surface. The carrier tape 18*b* from which the composition has been peeled off is guided by a guide pin 14*d*" and taken up by the takeup reel 22.

The boss parts 31*a* and 31*b* are integrated with the gears 32*a* and 32*b*, respectively. The gears 32*a* and gears 32*b* mesh with each other to configure a transmission mechanism, and the feed reel 20 and the takeup reel 22 are interlocked by the gears 32*a* and 32*b*, so that the takeup reel 22 turns in the takeup direction, along with the turning of the feed reel 20 in the feeding direction, to takeup the carrier film 18*b*.

As shown in FIG. 2, the boss part 31*a* includes a plurality of ,e.g., three boss pieces 31*a*-1, 31*a*-2 and 31*a*-3 (the boss piece 31*a*-3 on this side of a sheet of FIG. 2 is shown in FIG. 1) separate from one another in the circumferential direction. Inside each boss piece are formed inner projections 31*c* and 31*e* in contact with the projecting shaft 14*b*, while outside each boss piece is formed an outer projection 31*d*. The inner projections 31*c* and 31*e* are formed at the upper and lower ends of the boss piece, and the outer projection 31*d* is formed midway between the inner projections 31*c* and 31*e* in the vertical direction.

Inside a region of the boss piece which positionally corresponds to the outer projection 31*d* is a void space. The outer projection 31*d* is in contact with the core 20*a* of the feed reel 20, and the strutting of the outer projection 31*d* of each of the plurality of boss pieces (e.g., 31*a*-1, 31*a*-2 and 31*a*-3) toward the outer circumference supports the core 20*a*. Since the boss part 31*a* includes the plurality of boss pieces separated in the circumferential direction, the boss pieces can flex toward the inner circumference when the feed reel 20 is installed, thereby facilitating the installation. After the feed reel 20 has been installed, the region of the boss piece between the inner projections 31*c* and 31*e* flexes as the area external to the outer projections 31*d* is a void space. Thus, the positions of the outer projections 31*d* are appropriately adjusted to optimize the strutting force operating from the boss part 31*a* toward the core 20*a* of the feed reel 20. Therefore, while the boss part 31*a* turns integrally with the feed reel 20 at normal times, if a takeup speed becomes faster than a feed speed to apply a greater tension on the tape, a slippage occurs between the outer projections 31*d* of the boss part 31*a* and the feed reel 20.

Figure 8:
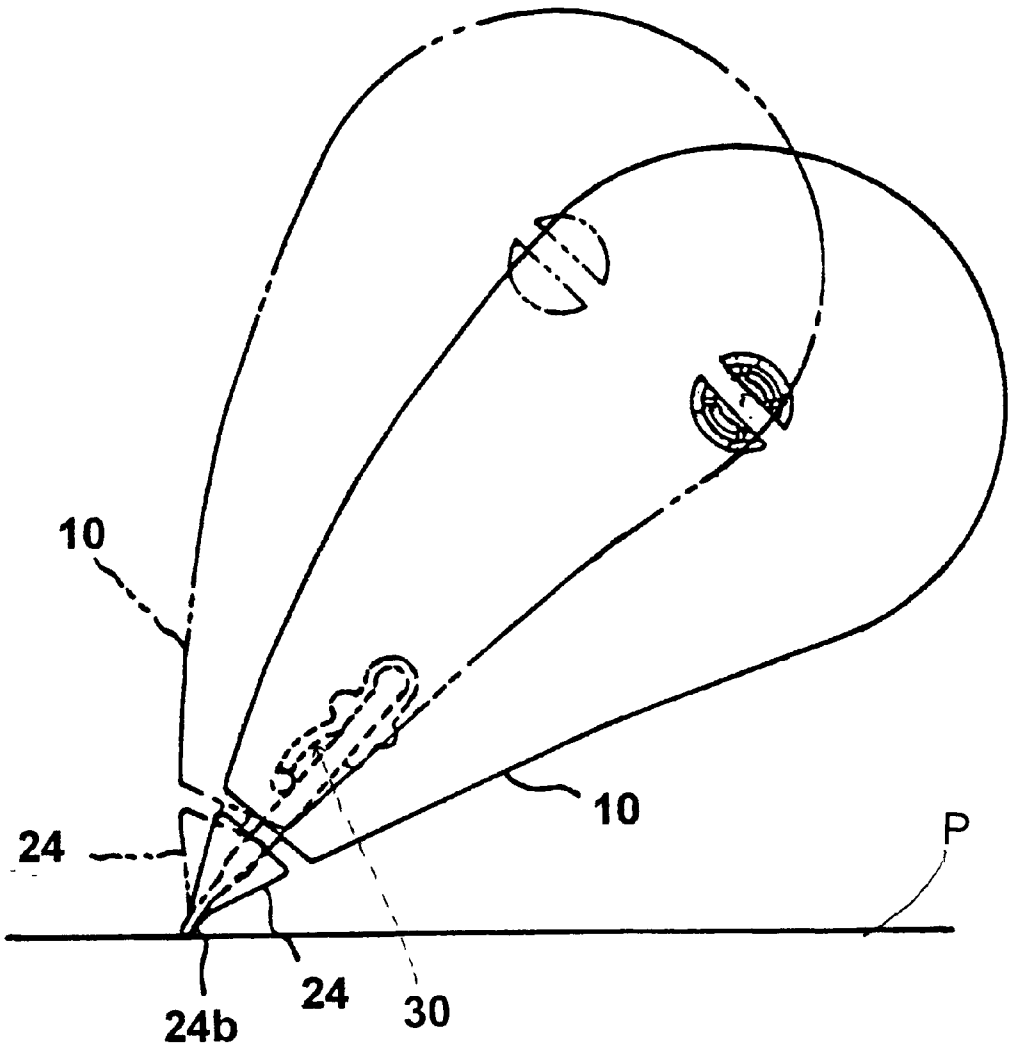
FIG. 8 shows an explanation view of the coat transfer tool of FIG. 1 when used.

When the coat transfer tool as configured above is used, the user moves the tip 24*b* of the applying strip 24 along the paper surface while pressing it against the paper surface P as shown in FIG. 8. The adhesive layer of the coat transfer tape 18*a* adheres to the paper surface, and the composition is transferred along with the adhesive layer. In this process, the applying strip 24 is pressed toward the elastic pressing arm 30 and receives the elastic force of the elastic pressing arm 30.

Since the gap 28 is provided between the base 24*a* of the applying strip 24 and the support body 26 as described above, the applying strip 24 is displaced toward the elastic pressing arm 30 and pressed against the paper surface while receiving the elastic force of the elastic pressing arm 30. Moving the applying strip 24 along the paper surface, the coat transfer tape 18*a* is fed from the feed reel 20. The takeup reel 22, turning with the feed reel 20, takes up the carrier film 18*b* after the composition and the adhesive layer have been peeled from the coat transfer tape 18*a*.

Once the transfer onto the paper surface is completed, the user applies additional force to the applying strip 24 to press it against the paper surface and raises the rear part of the applying strip 24 (e.g., indicated by imaginary lines in FIG. 8). The applying strip 24 is displaced by an increased elastic force from the elastic pressing arm 30 which is perpendicular to the paper surface. This results in the composition and the adhesive layer transferred to the paper surface becoming severed from the unused portion of the composition and the adhesive layer remaining on the coat transfer tape 18*a* at the tip 24*b* of the applying strip 24. The applying strip 24 is displaced by the elasticity of the elastic pressing arm 30 to provide a sharp cut line.

As described above, in this embodiment of the invention, the elastic pressing arm 30 provides sufficient elastic force to the applying strip 24, to buffer the force that the applying strip 24 receives from the paper surface, and simultaneously places the applying strip 24 and the paper surface at the desired angles to transfer or sever the composition and the adhesive, respectively.

Accordingly, when a composition transferring operation is to be continued, the composition and the adhesive layer are reliably supplied from the applying strip 24 to the paper surface without unintentionally cutting and, when transfer is completed, the composition and the adhesive layer can be neatly cut.

Second Embodiment

Figure 9:
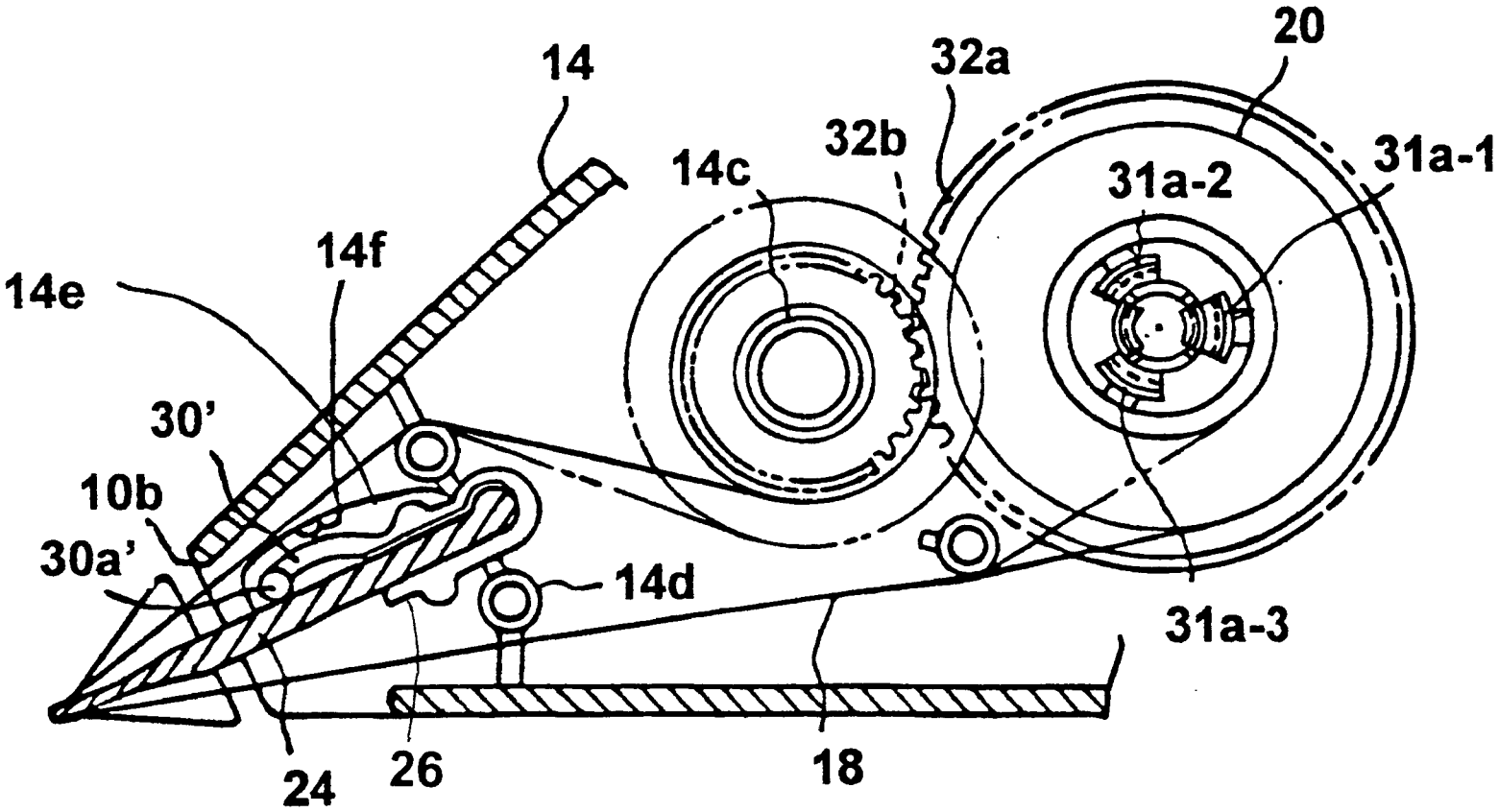
FIG. 9 illustrates a second preferred embodiment of the present invention.

FIG. 9 illustrates a second preferred embodiment of the present invention. The same members, as in the first embodiment, are assigned the same reference numerals and, for brevity, a detailed description is not repeated.

This embodiment differs from the first embodiment in that a projection 14*f* as a limiting unit, extends from the edge of the side window 14*e* of the lower case 14. Further, the tip 30*a*' of the elastic pressing arm 30' does not extend to the side window 14*e*, and the range of displacement of the elastic pressing arm 30' is limited by the projection 14*f*. This embodiment provides the same effects and advantages as the first embodiment does. Many other variations are also feasible in addition to those described above.

Third Embodiment

Figure 10:
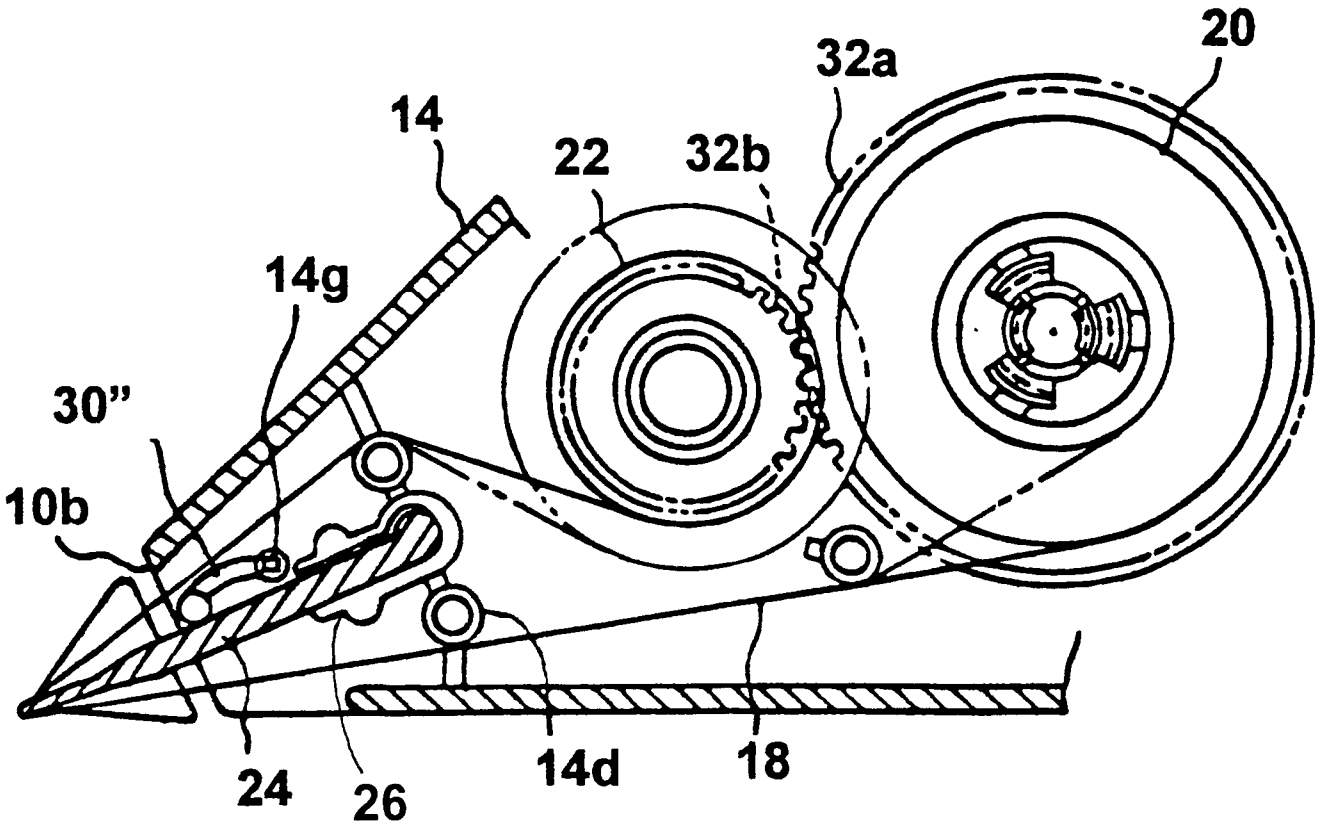
FIG. 10 illustrates a third preferred embodiment of the present invention.

The embodiment illustrated in FIG. 10, for example, differs from the first embodiment in that the elastic pressing arm 30" is separate from the lower case 14. In the base of the elastic pressing arm 30" a hole is bored having a noncircular section. In this case, a supporting pillar 14*g* matching the hole having the noncircular section is provided on the lower case 14. In this manner the base of the elastic pressing arm 30" is prevented from turning relative to, and is substantially fixed to, the lower case 14.

In contrast, the tip of the elastic pressing arm 30@ can be displaced along the plate-shaped part 14*a* of the lower case 14, as in the first embodiment. In this way, even though the elastic pressing arm 30@ is separate from the lower case 14 and the supporting body 26, effects and advantages similar to those of the first embodiment shown in FIG. 1 can be obtained.

Fourth Embodiment

Figure 11:
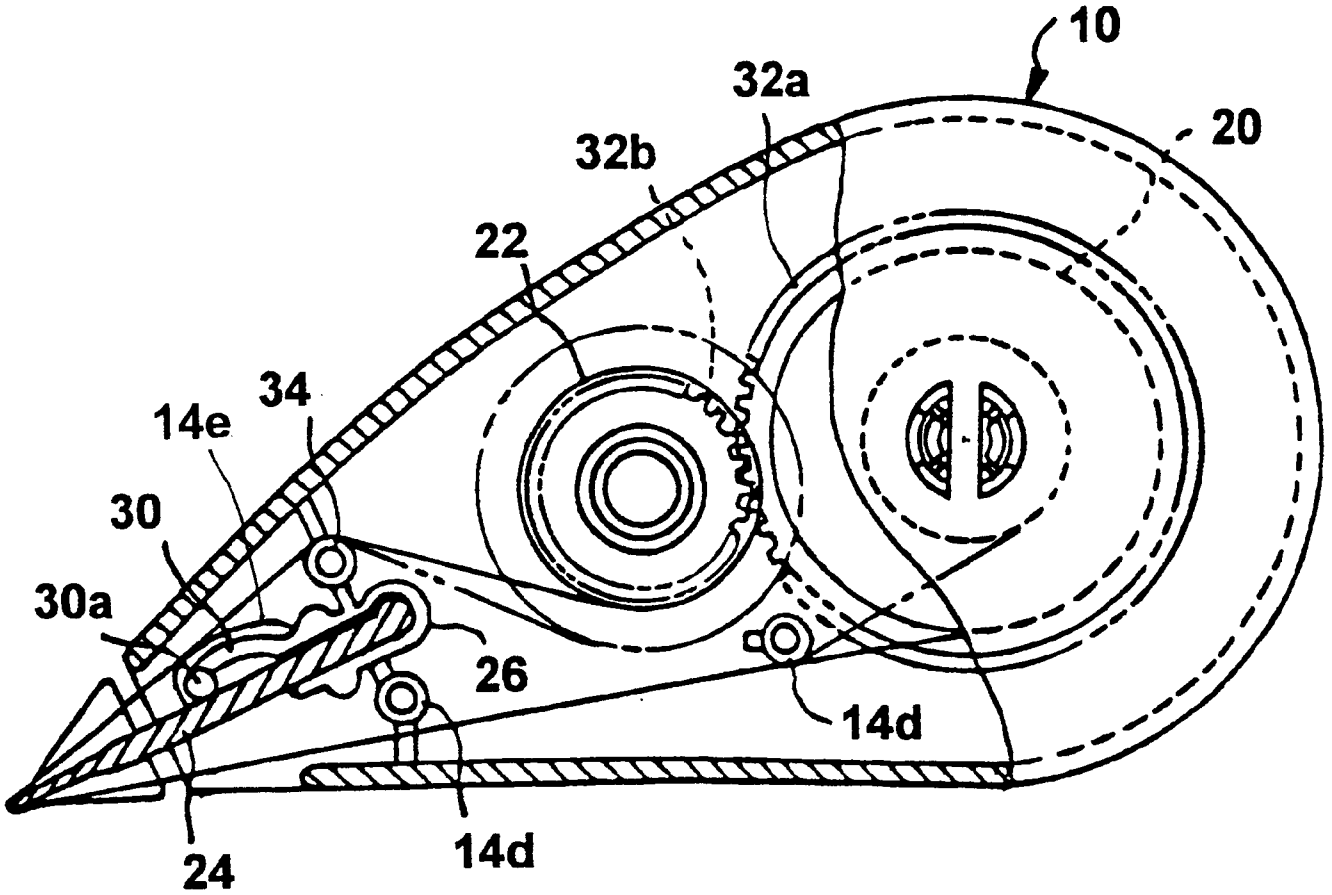
FIG. 11 illustrates a fourth preferred embodiment of the present invention.

In the embodiment shown in FIG. 11, one guide pin 34 is formed integrally with the elastic pressing arm 30 and the supporting body 26, again providing the same effects and advantages as the first embodiment does.

The elastic pressing arm provides sufficient elastic force to the applying strip, and the force that the applying strip receives from the paper surface is buffered. Simultaneously, when the composition and the adhesive layer are to be transferred or cut, the applying strip can be placed at the respectively appropriate angles relative to the paper surface. Therefore, when transferring is to be continued, the composition and the adhesive layer are reliably supplied from the transferring tool to the paper surface without being unintentionally cut and, when transfer is complete, the composition and the adhesive layer can be neatly cut.

While the invention has been described in terms of several preferred embodiments, those skilled in the art will recognize that the invention can be practiced with modification within the spirit and scope of the appended claims.

Having thus described our invention, what we claim as new and desire to secure by Letters Patent is as follows:

1. A coat transfer tool comprising:

a case having a plate-shaped part;

a feed reel provided in the case and wound with a coat transfer tape;

a takeup reel, disposed in the case, for winding a carrier tape which is fed from the feed reel and whose coat of composition has been peeled off;

a transmitting unit for transmitting revolutions between the feed reel and the takeup reel slippably;

an applying strip disposed on a path of the tape between the feed reel and the takeup reel and for being pressed against a surface of a substrate; and an elastic pressing body, projecting from the plate-shaped part of the case and kept in contact with a surface of the applying strip, for elastically pressing the applying strip, wherein the pressing is performed in a substantially vertical direction to the surface of the applying strip.

2. The coat transfer tool, as set forth in claim 1, wherein said elastic pressing body protrudes from and is integrated with the plate-shaped part of the case.

3. The coat transfer tool as set forth in claim 2, wherein said plate-shaped part of the case integrated with said elastic pressing body has a side window located where said case overlaps said elastic pressing body as viewed in a direction substantially orthogonal to the plate-shaped part.

4. The coat transfer tool as set forth in claim 3, wherein an edge of the side window of said case includes a limiting unit to limit the movement of said elastic pressing body.

5. The coat transfer tool, as set forth in claim 1, wherein a supporting body for supporting a proximal end of the applying strip is formed integrally with said elastic pressing body.

6. A coat transfer tool, as set forth in claim 1, wherein said case comprises an upper case and a lower case, and wherein one of the upper case and the lower case includes a protruding shaft for pivoting one of said feed reel and said takeup reel, said protruding shaft including a pair of engaging pieces whose tips are separated and oppose each other, an engaging part being formed at the tip of each engaging piece, and wherein the other one of the upper case and the lower case includes an engaging projection engaged by said engaging part to be gripped by said pair of engaging pieces and a slit is formed near said engaging projection corresponding to said engaging part.

7. The coat transfer tool, as set forth in claim 2, wherein a supporting body for supporting a proximal end of the applying strip is formed integrally with said elastic pressing body.

8. The coat transfer tool, as set forth in claim 3, wherein a supporting body for supporting a proximal end of the applying strip is formed integrally with said elastic pressing body.

9. The coat transfer tool, as set forth in claim 4, wherein a supporting body for supporting a proximal end of the applying strip is formed integrally with said elastic pressing body.

10. A coat transfer tool, as set forth in claim 2, wherein said case comprises an upper case and a lower case, and wherein one of the upper case and the lower case includes a protruding shaft for pivoting one of said feed reel and said takeup reel, said protruding shaft includes a pair of engaging pieces whose tips are separated and oppose each other, an engaging part being formed at the tip of each engaging piece, and wherein the other one of the upper case and the lower case includes an engaging projection engaged by said engaging part to be gripped by said pair of engaging pieces and a slit is formed near said engaging projection corresponding to said engaging part.

11. A coat transfer tool, as set forth in claim 3, wherein said case comprises an upper case and a lower case, and wherein one of the upper case and the lower case includes a protruding shaft for pivoting one of said feed reel and said takeup reel, said protruding shaft including a pair of engaging pieces whose tips are separated and oppose each other, an engaging part being formed at the tip of each engaging piece, and wherein the other one of the upper case and the lower case includes an engaging projection engaged by said engaging part to be gripped by said pair of engaging pieces and a slit is formed near said engaging projection corresponding to said engaging part.

12. A coat transfer tool, as set forth in claim 4, wherein said case comprises an upper case and a lower case, and wherein one of the upper case and the lower case includes a protruding shaft for pivoting one of said feed reel and said takeup reel, said protruding shaft including a pair of engaging pieces whose tips are separated and oppose each other, an engaging part being formed at the tip of each engaging piece, and wherein the other one of the upper case and the lower case includes an engaging projection engaged by said engaging part to be gripped by said pair of engaging pieces and a slit is formed near said engaging projection corresponding to said engaging part.

13. A coat transfer tool as set forth in claim 5, wherein said case comprises an upper case and a lower case, and wherein one of the upper case and the lower case includes a protruding shaft for pivoting one of said feed reel and said takeup reel said protruding shaft including a pair of engaging pieces whose tips are separated and oppose each other, an engaging part being formed at the tip of each engaging piece, and wherein the other one of the upper case and the lower case includes an engaging projection engaged by said engaging part to be gripped by said pair of engaging pieces and a slit is formed near said engaging projection corresponding to said engaging part.

14. The coat transfer tool as claimed in claim 6, wherein the engaging projection is operated through the slit.

15. A coat transfer tool comprising:

a case;

a feed reel provided in the case and wound with a coat transfer tape;

a takeup reel, disposed in the case, for winding a carrier tape which is fed from the feed reel and whose coat of composition has been peeled off;

a transmitting unit for transmitting revolutions between the feed reel and the takeup reel slippably;

an applying strip disposed on a path of the tape between the feed reel and the takeup reel and for being pressed against a surface of a substrate; and an elastic pressing body for elastically pressing the applying strip, wherein the pressing is performed in a substantially vertical direction to the surface of the applying strip.

16. The coat transfer tool, as set forth in claim 15, wherein said elastic pressing body protrudes from and is integrated with the case.

17. The coat transfer tool, as set forth in claim 16, wherein said case integrated with said elastic pressing body has a side window located where said case overlaps said elastic pressing body as viewed in a direction substantially orthogonal to the case.

18. The coat transfer tool as set forth in claim 17, wherein an edge of the side window of said case includes a limiting unit to limit the movement of said elastic pressing body.

19. The coat transfer tool as set forth in claim 15, wherein a supporting body for supporting an end of the applying strip is formed integrally with said elastic pressing body.

20. A coat transfer tool, as set forth in claim 15, wherein said case comprises an upper case and a lower case, and wherein one of the upper case and the lower case includes a protruding shaft for pivoting one of said feed reel and said takeup reel, said protruding shaft including a pair of engaging pieces whose tips are separated and oppose each other, an engaging part being formed at the tip of each engaging piece, and wherein the other one of the upper case and the lower case includes an engaging projection engaged by said engaging part to be gripped by said pair of engaging pieces and a slit is formed near said engaging projection corresponding to said engaging part.

* * * * *